US005538242A

United States Patent [19]

Doucet

[11] Patent Number: 5,538,242

[45] Date of Patent: Jul. 23, 1996

[54] SIGNATURE AIMING DEVICE

[75] Inventor: Louis J. Doucet, Salem, N.H.

[73] Assignees: Heidelberger Druckmaschinen AG, Heidelberg, Germany; Heidelberg Harris Inc., Dover, N.H.

[21] Appl. No.: 267,212

[22] Filed: Jul. 8, 1994

[51] Int. Cl.[6] ..... B65H 39/065

[52] U.S. Cl. ..... 271/299

[58] Field of Search ..... 271/299, 302, 271/200, 315, 272, 273, 274; 270/13, 39, 47, 60

[56] References Cited

U.S. PATENT DOCUMENTS

| | | | |
|---|---|---|---|
| 4,244,565 | 1/1981 | Geir | 271/315 X |
| 4,373,713 | 2/1983 | Loebach | 271/302 X |
| 4,593,896 | 6/1986 | Nakamura | 271/315 X |
| 4,925,173 | 5/1990 | Lindblom et al. | 271/315 X |
| 4,925,179 | 5/1990 | Breton et al. | 271/315 X |
| 4,955,964 | 9/1990 | Hain | 271/302 X |
| 5,029,842 | 7/1991 | Belanger et al. | 271/188 |
| 5,064,180 | 11/1991 | Wingate | 270/47 |
| 5,112,033 | 5/1992 | Breton | 270/47 |
| 5,180,160 | 1/1993 | Belanger et al. | 271/315 |
| 5,249,791 | 10/1993 | Belanger et al. | 271/315 X |

FOREIGN PATENT DOCUMENTS

| | | | |
|---|---|---|---|
| 0527317 | 2/1993 | European Pat. Off. | 271/315 |
| 0280087 | 6/1990 | Germany | 271/315 |
| 0280088 | 6/1990 | Germany | 271/315 |
| 0037657 | 2/1986 | Japan | 271/315 |
| 0127558 | 5/1989 | Japan | 271/315 |
| 1094126 | 12/1967 | United Kingdom | 271/302 |

*Primary Examiner*—William E. Terrell
*Assistant Examiner*—Tamara Kelly
*Attorney, Agent, or Firm*—Kenyon & Kenyon

[57] ABSTRACT

A folder apparatus is disclosed which has at least one lead-in tape mechanism having a left lead-in tape and left exit roller and a corresponding right lead-in tape and right exit roller, the right and left lead-in tapes forming a signature passage for delivery of a signature, and the left exit rollers being at a different height than the right exit rollers. A signature aiming device controls the direction of the signature path by moving one or both sets of exit rollers.

6 Claims, 5 Drawing Sheets

SIGNATURE AIMING DEVICE

FIELD OF THE INVENTION

The invention relates generally to printing presses and more particularly to a folder apparatus for a printing press for delivering signatures.

BACKGROUND OF THE INVENTION

Lead-in tape systems are commonly used to deliver signatures from a printing press to a stack. A lead-in tape system typically comprises a plurality of lead-in tape mechanisms spaced apart from one another and located side-by-side to one another to contact the signature across its width. Each lead in-tape mechanism has a lead-in tape on one side and a corresponding counter-rotating lead-in tape on the other side to form a signature passage, so that the signature is grasped on both sides and may be transported through the signature passage. Often the signature leaves the signature passage and enters a fan which receives the signature in a fan pocket. The signature is then delivered to a stack as the fan rotates. As described in U.S. Pat. No. 5,112,033, herewith incorporated by reference, it is often desirable to place two fans downstream from a single signature stream.

The lead-in tapes typically have guide rollers and a drive roller located inside the lead-in tape for guiding and driving the tape. There are guide rollers at the bottom of the lead-in tape where the signature exits, i.e. the exit rollers.

The exit rollers on one side of a signature are often the same height as the exit rollers on the other side of the signature to ensure that the signatures exit straight.

There are several problems associated with having the exit rollers on one side of a signature the same height as the corresponding exit rollers on the other side of the signature. The even height of the exit rollers causes pounding between the exit rollers, since there is a heavy spring-loaded pressure between the exit rollers. Premature failure of the bearings, tapes or other components may occur, as well as fretting corrosion of the loaded components. Another problem associated with even height of the corresponding exit rollers is slippage of exit roller levers which hold the exit roller. Paper jams are more likely to occur between the heavily loaded exit rollers, which also may lead to lever slippage or premature failure of components. Moreover, the set up of the lead-in tape rollers is difficult because of the required precision to assure that the signatures are properly directed into the fan pockets.

It has therefore been found desirable to reduce the pressure on even height corresponding exit rollers by staggering them, i.e. having the exit roller on one side of a signature be higher or lower than the corresponding exit roller on the other side of the exit roller. This reduces the pressure between the exit rollers. However, the signatures are then often directed or deflected away to the side of the higher exit roller, which can cause problems, especially when a dual fan system is used, because the signatures should exit almost straight so that a signature is directed into the alternating fan pockets of the two fans. This problem is heightened because the thickness of a signature will effect the amount of the deflection when staggered exit rollers are used, therefore often making adjustments necessary when the thickness of the signature is changed.

In U.S. Pat. No. 5,112,033, the bottom rollers of two transport tapes 13 are fixed and slightly staggered, so that one exit roller is higher than its corresponding exit roller.

However, the patent is directed to the fans and does not discuss the exit rollers.

U.S. Pat. No. 5,064,180 shows delivery of signatures through signature conveyor belts 14 and 15, the signatures being directly deposited into a stack.

U.S. Pat. No. 5,029,842 to Belanger et. al. discloses a signature delivery apparatus having six side-by-side signature lead-in tapes for delivering signatures to single fans.

SUMMARY OF THE INVENTION

An object of the present invention is to reduce pressure between lead-in tape rollers.

Another object of the invention is to allow for controlled delivery of signatures being delivered through a lead-in tape mechanism to a fan.

A still further object of the invention is to provide proper direction of the signatures, regardless of signature thickness.

The present invention therefore also provides a folder apparatus comprising: at least one lead-in tape mechanism having a left lead-in tape and left exit roller and a corresponding right lead-in tape and right exit roller, the right and left lead-in tapes forming a signature passage for delivery of a signature; the left exit roller being at a different height than the right exit roller; the right exit roller rotatable about a fixed axis; and an arm for supporting the left exit roller, the left exit roller rotatably mounted on the arm about a left roller axis, the arm being moveable to move the left roller axis, so as to allow a change in the direction of the signature delivery.

This arrangement allows for precise control of the signature direction and also allows for corrections to the signature direction when the signature thickness changes. This is accomplished by manipulating the relative location of the corresponding exit roller axes of all of the side-by-side lead-in tape mechanisms.

BRIEF DESCRIPTION OF THE DRAWINGS

The present invention will be described in greater detail with respect to the drawings below:

FIG. 2(*a*) shows a front view of the signature aiming device according to an embodiment of the present invention.

DETAILED DESCRIPTION OF THE INVENTION

Figure 1:
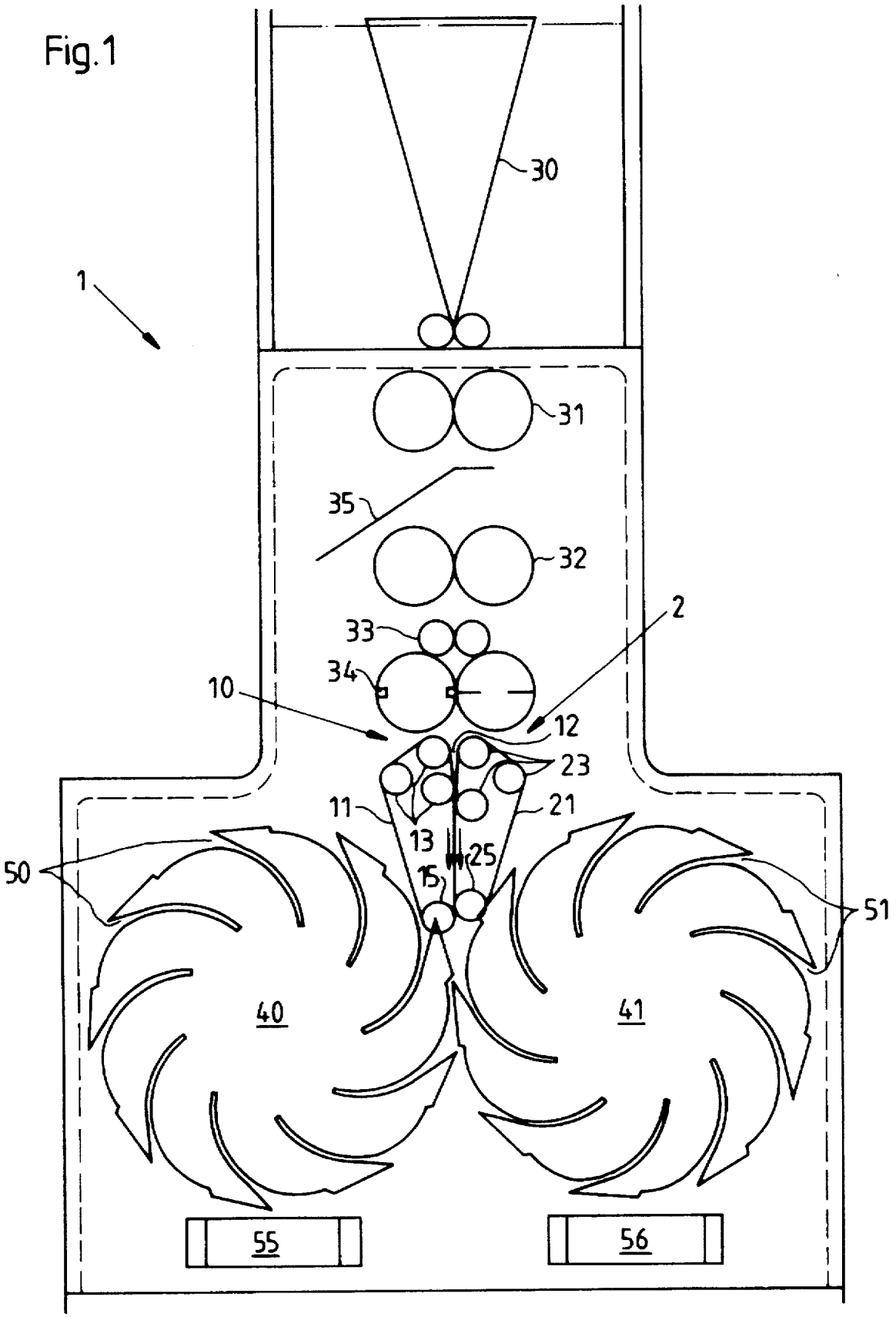
FIG. 1 shows a side-view of a typical folder apparatus for web-fed printing press having the signature aiming device of the present invention.

FIG. 1 shows a folder apparatus 1 for a web-fed printing press. The printed webs are conducted over a former 30 and folded. After being folded, the web is fed through the nips of upper and lower draw rollers 31 and 32, respectively, and guide rollers 33 to a cutting cylinder 34, which severs the web to form printed signatures. A web separating device 35 is provided between the upper draw rollers 31 and the lower draw rollers 32.

The signatures are then fed by a lead-in tape system 2 to fan pockets 50 and 51 of fans 40 and 41, respectively. As the fans 40 and 41 rotate, the signatures are deposited to stacks 55 and 56, respectively. The lead-in tape system 2 has at least one lead-in-tape mechanism, and preferably more than one side-by-side and parallel lead-tape mechanisms with coaxial exit rollers, including a first lead-in tape mechanism 10, for grasping the signatures across its width.

The first lead-in tape mechanism 10 has a left lead-in tape 11 and a corresponding right lead-in tape 21, forming a signature passage 12. The lead-in tape mechanism 10 also has left upper rollers 13 and right upper rollers 23, which can comprise guide or drive rollers for guiding and driving the left and right lead-in tapes 11 and 21, respectively. The lead in-tape mechanism 10 also has left exit roller 15 and corresponding right exit roller 25.

Figure 2:
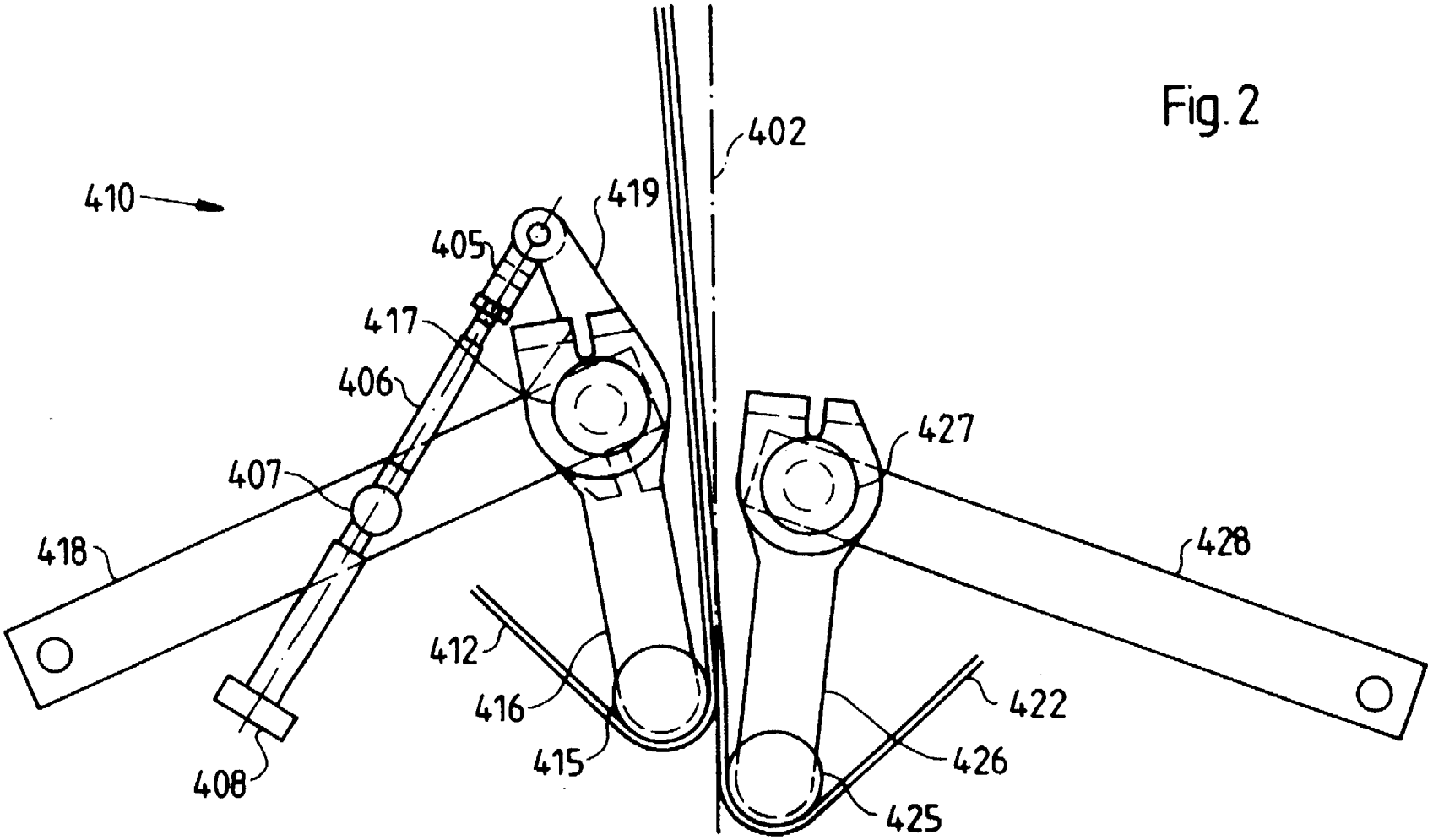
FIG. 2 shows a side view of the signature aiming device for the exit rollers.
Figure 2A:
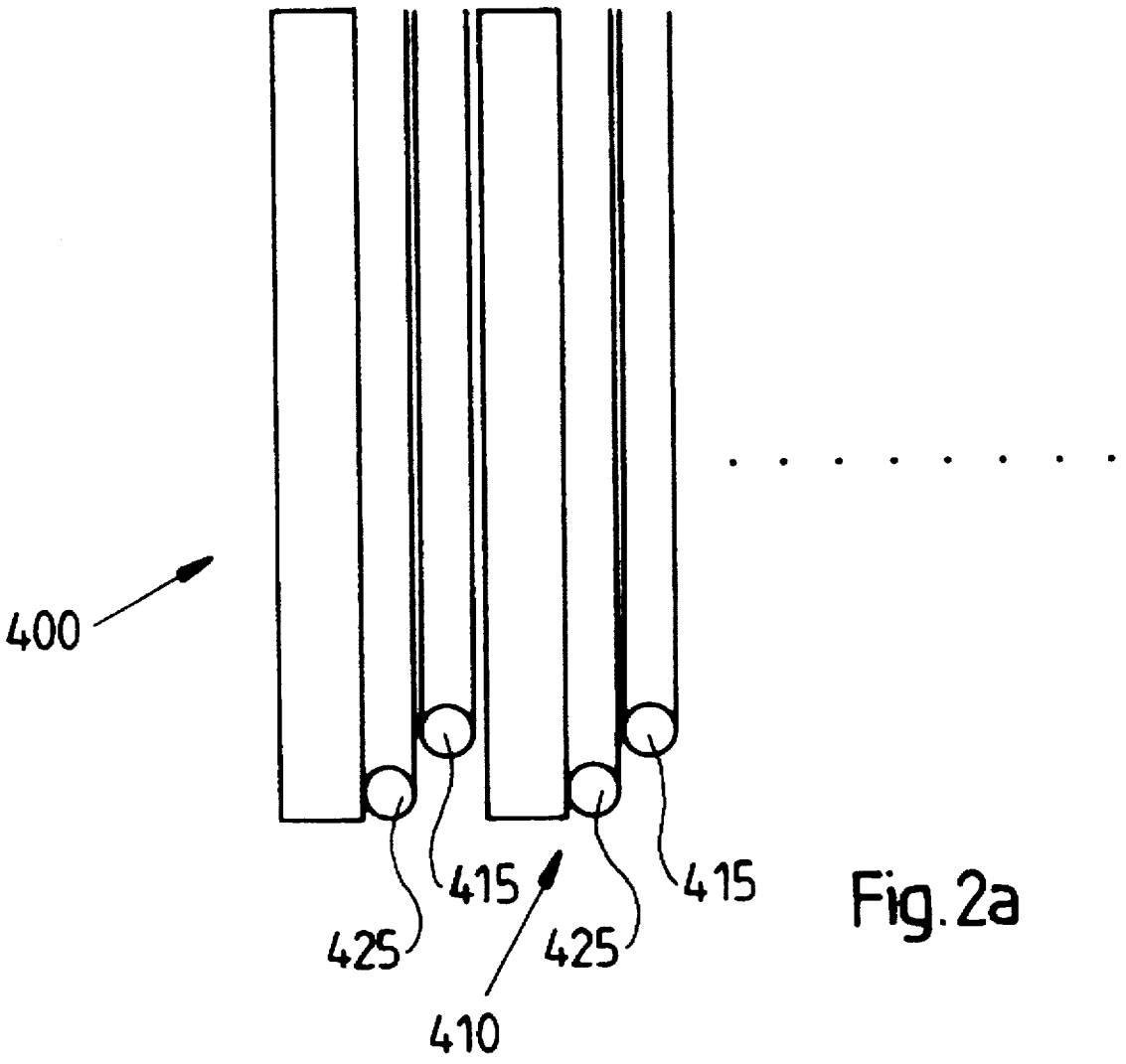

The lead-in tape system 2 of FIG. 1 is shown in greater detail in FIG. 2. A lead-in tape mechanism 410, one of preferably a plurality of side-by-side lead in tape mechanisms (as shown in FIG. 2(*a*)) which would include first lead-in-tape mechanism 10, has a left lead-in tape 412 and a corresponding right lead-in tape 422. The left exit roller 415 is mounted at one end on a left exit roller lever 416, which is fixedly mounted at the other end to a pivotable stud 417. Pivotable stud 417 is pivotable with a frame component 418. On the right side, right exit roller 425 is rotatably mounted on one end on a right exit roller lever 426, which is fixedly mounted at the other end to a fixed stud 427. Fixed stud 427 is fixedly mounted to a frame component 428, so that the right exit roller 425 can rotate but is translationally fixed during operation.

The studs 417, 427 extend axially to connect to multiple levers, including levers 416 and 426, respectively, of preferably several side-by-side lead-in tape mechanisms.

An adjustment arm 419 is also fixedly clamped to the pivoting stud 417 at one axial location. Connected to the arm 419 is an adjustment mechanism comprising a rod end bearing 405, a threaded stud 406, a pivot block 407, and an adjustment knob 408. The movement of the top end of the adjustment arm 419 rotates the pivotable stud 417, which in turn moves the lever 416 to pivot the axis of left exit roller 415 about the stud 417.

The adjustment knob 408 therefore allows for controlled movement of the left exit roller axis. By turning the adjustment knob 408, the threaded stud 406 changes the distance between the rod end bearing 405 and the pivot block 407 to move the top end of the adjustment arm 419.

Using the adjustment knob 408, the trajectory of the signatures can be varied about a vertical center line 402 of the folder. This action will be described in greater detail with reference to FIGS. 3 and 4.

Figure 3:
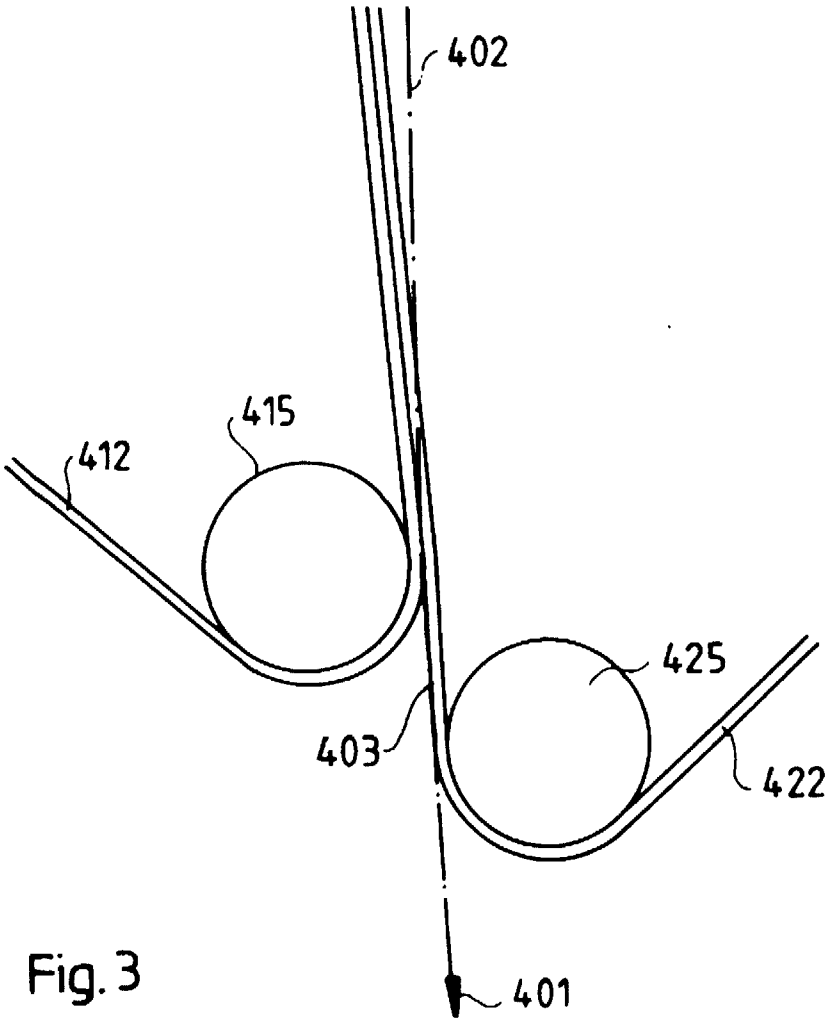

In FIG. 3, the rollers 415, 425 are positioned such that the signature path 403 exiting the lead-in tapes 412 and 422 is parallel to a vertical center line 402 of the folder. In this position, the trajectory 401 of the signature is also vertical. It should be noted that if the signature thickness is varied, the trajectory of the signature may change.

Figure 4:
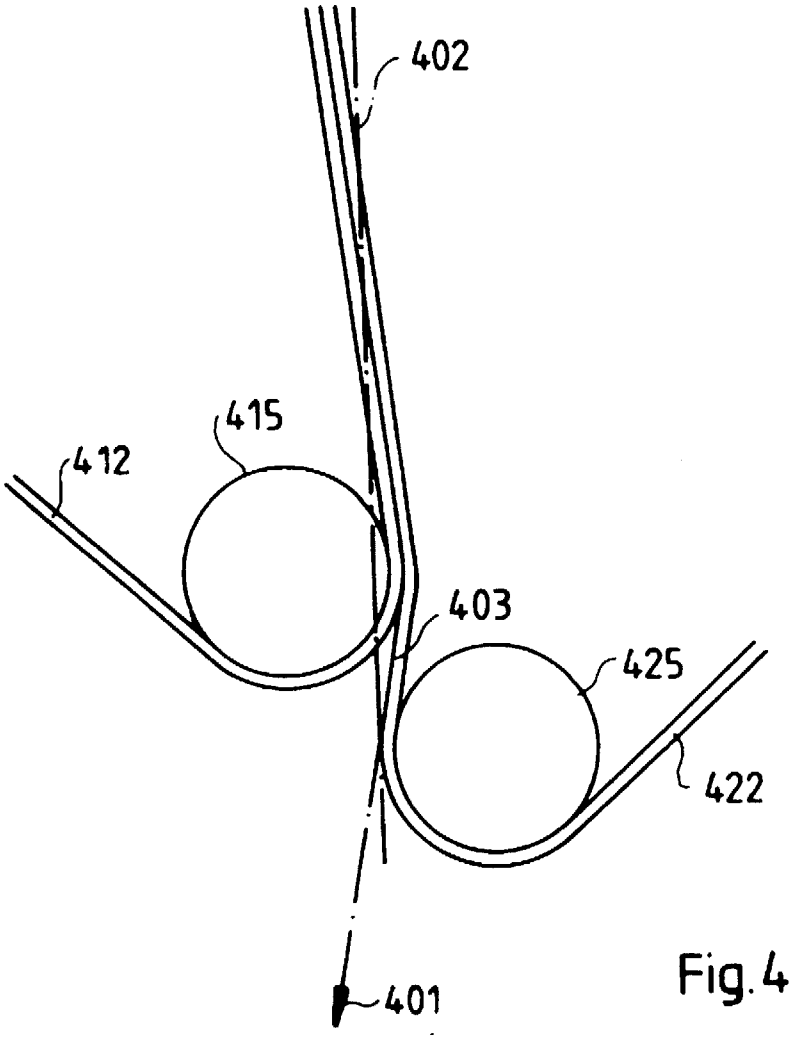
FIGS. 3 and 4 are schematic views of the exit rollers of FIG. 2, showing the effect of the control mechanism.

In FIG. 4, the axis of the left exit roller 415 has been moved towards the right. Since the right exit roller 425 remains fixed, the result is an angular change in the tape path 403 between the exit rollers. Since the signatures follow the tape path 403, the trajectory 401 of the signatures is also altered, as shown.

While the movement of the left exit roller has been shown in conjunction with a hand-controlled adjustment mechanism, it would also be possible to replace the adjustment mechanism with a motor. Also, it is contemplated that various adjustment mechanisms could be used for controlled movement of the left roller axis, rather than the lever-pivotable stud-adjustment arm embodiment described above. Moreover, while the control mechanism has been described with respect to higher exit bearings, it could also be placed to change the position of the lower exit bearings or of both.

It should be noted that the lead-in tape mechanisms need not be spaced apart equally from one another, and may be moveable in the axial direction from the other tape mechanisms. Also, the terms "left" and "right" have been used merely for clarity and the folder apparatus can be viewed from either side.

Figure 5:
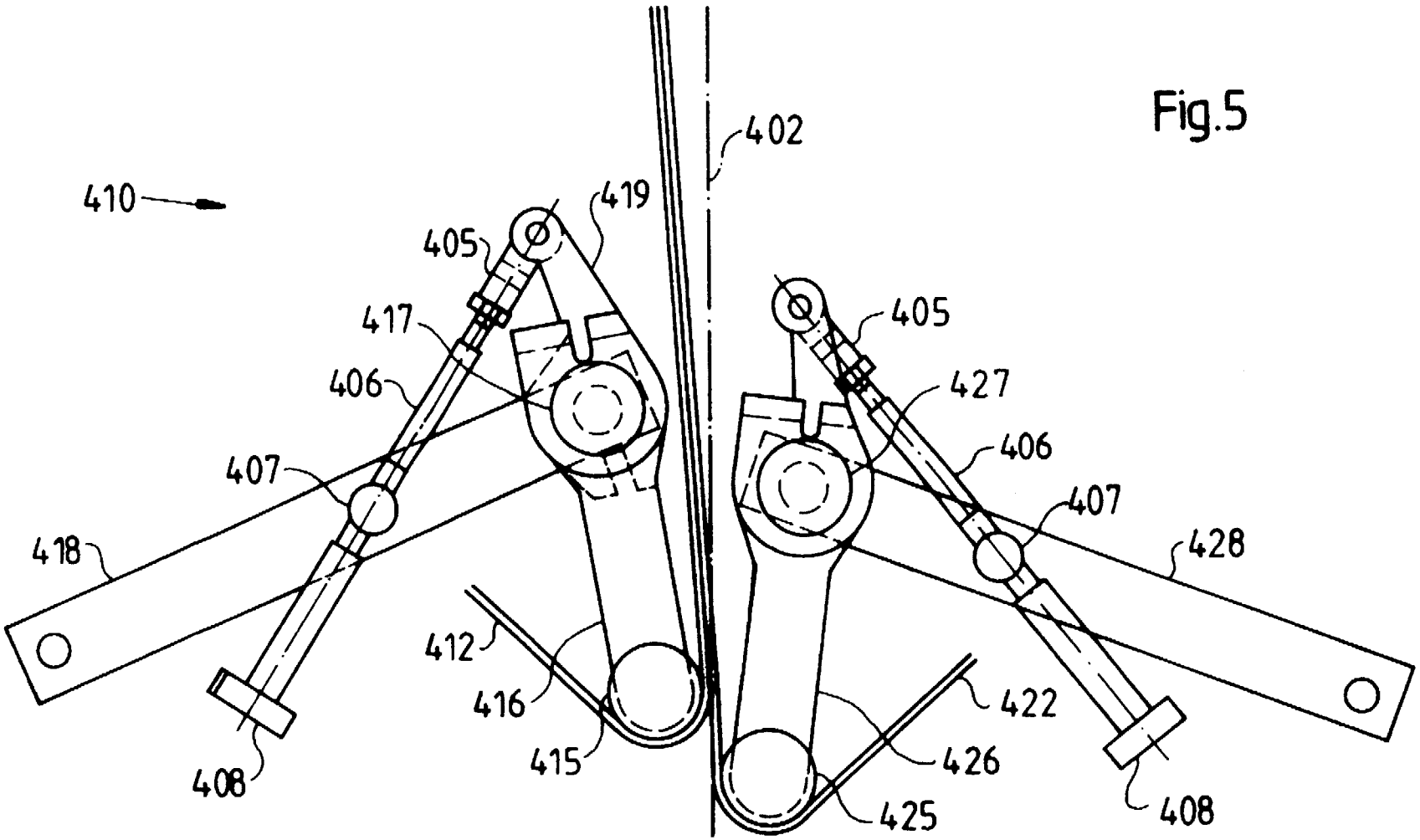
FIG. 5 shows a further embodiment of the present invention.

While the present invention has been detailed in the embodiment described above, it is also contemplated the invention may encompass further embodiments than those described, including moving both the right and left sets of exit rollers instead of just the left or just the right as shown in FIG. 5 with like components bearing like reference numerals to FIG. 2.

What is claimed is:

1. A folder apparatus comprising:

at least one lead-in tape mechanism having a left lead-in tape and left exit roller and a corresponding right lead-in tape and right exit roller, the right and left lead-in tapes forming a signature passage for delivery of a signature; the left exit roller being at a different height than the right exit roller;

the right exit roller rotatable about a fixed axis;

a lever for supporting the left exit roller, the left exit roller rotatably mounted on the lever about a left roller axis, the lever being moveable to move the left roller axis, so as to allow a change in the direction of the signature delivery;

an arm fixedly connected to a pivotable stud at one axial location, the pivotable stud connected to the lever.

2. The folder apparatus as recited in claim 1 the lever being connected at one end to the pivotable stud and at the other end to the left exit roller.

3. The folder apparatus as recited in claim 1 further comprising a control mechanism for moving the arm.

4. The folder apparatus as recited in claim 1 wherein there are at least two lead-in tape mechanisms.

5. The folder apparatus as recited in claim 1 wherein the left exit roller is higher than the right exit roller.

6. The folder apparatus as recited in claim 1 wherein the left exit roller is lower than the right exit roller.

* * * * *